US005667144A

United States Patent [19]

Snetting

[11] Patent Number: 5,667,144

[45] Date of Patent: Sep. 16, 1997

[54] PAINT GUN WITH CO-MOLDED SWIRL VALVE

[75] Inventor: Mark E. Snetting, Eden Prairie, Minn.

[73] Assignee: Wagner Spray Tech Corporation, Minneapolis, Minn.

[21] Appl. No.: 429,925

[22] Filed: Apr. 27, 1995

[51] Int. Cl.[6] ..... B05B 1/34

[52] U.S. Cl. ..... 239/491; 239/497

[58] Field of Search ..... 239/461, 310, 239/490–494, 463, 333, 497

[56] References Cited

U.S. PATENT DOCUMENTS

| | | | |
|---|---|---|---|
| 1,493,150 | 5/1924 | Deming | 239/491 |
| 2,349,449 | 5/1944 | Meador | 239/491 |
| 2,606,071 | 7/1952 | Vensel | 239/491 |
| 2,767,023 | 10/1956 | Venus | 239/491 |
| 3,899,134 | 8/1975 | Wagner | 239/332 |
| 4,036,438 | 7/1977 | Soderlind | 239/288.5 |
| 4,791,826 | 12/1988 | Behrens | 74/473 R |
| 4,818,829 | 4/1989 | Nopper | 200/512 |
| 4,920,671 | 5/1990 | Zatkos | 40/301 |
| 4,977,718 | 12/1990 | Hoffman | 52/288 |
| 5,030,135 | 7/1991 | Plesinger | 439/447 |
| 5,169,023 | 12/1992 | Heiberg | 220/574 |
| 5,219,922 | 6/1993 | Steinberger | 524/785 |
| 5,224,859 | 7/1993 | Kraenzle | 433/126 |
| 5,242,170 | 9/1993 | Ward | 273/207 |
| 5,251,474 | 10/1993 | Wardlaw | 73/61.41 |

FOREIGN PATENT DOCUMENTS

| | | | |
|---|---|---|---|
| 227624 | 5/1959 | Australia | 239/494 |

OTHER PUBLICATIONS

3pp from a Phillips Plastics Corporation brochure on Insert Multi–color Molding Division dated before Apr. 27, 1995.

*Primary Examiner*—Robert J. Oberleitner
*Assistant Examiner*—C. T. Bartz
*Attorney, Agent, or Firm*—Faegre & Benson

[57] ABSTRACT

An airless spray paint gun having an improved swirl valve which is less susceptible to erosion and reduces the amount of sputtering in the paint spray. The spray paint gun includes a gun assembly including a handle, a motor, and a switch for controlling the motor. A pump subassembly mounted to the gun assembly includes a pumping chamber having a discharge end with a beveled seat, a piston mounted within a pump housing and driven by the motor for pumping paint from the container through the discharge end of the pumping chamber, and a swirl valve mounted within the discharge end of the pumping housing. The swirl valve includes a valve body having first and second opposite sides, three paint swirl apertures extending through the valve body between the first and second opposite sides, a beveled seat-engaging surface on the second side of the valve body formed of an elastomeric material co-molded with the valve body. The elastomeric material is softer than the material of the valve body.

12 Claims, 3 Drawing Sheets

PAINT GUN WITH CO-MOLDED SWIRL VALVE

BACKGROUND OF THE INVENTION

1. Field of the Invention

The present invention relates generally to paint spray guns of the type including atomizing or swirl valves seated within an outlet chamber of a paint pump subassembly. In particular, the present invention relates to a paint spray gun with a swirl valve having an elastomer seat-engaging surface integrally molded therewith.

2. Description of the Related Art

Airless paint spray guns, also sometimes known as cup guns, are generally known and in widespread use. Spray guns of this type are commercially available from Wagner Spray Tech corporation of Minneapolis Minn., the assignee of the present invention, and are disclosed in the Wagner U.S. Pat. No. 3,899,134 and the Soderlind et al. U.S. Pat. No. 4,036,438. These spray guns include a paint cup or container that is releasably mounted to a portable gun assembly which includes a pump subassembly and a spray tip. The gun assembly includes a handle with a trigger-type on/off switch, and a motor for driving a piston in the pump subassembly.

Pump subassemblies of the type shown in the Soderlind et al. patent referred to above include a pumping chamber connected to and supplying an outlet chamber. The piston is reciprocatingly driven within the pumping chamber by a linear motor. The pumping chamber is preferably fabricated of aluminum, stainless steel or another relatively hard and corrosion resistant metal. A replaceable poppet valve member is lightly spring biased into engagement with a valve seat at the inlet to the outlet chamber. A replaceable swirl valve having a beveled surface is located at a discharge end of the outlet chamber and is positioned adjacent an atomizing spray tip, with the beveled surface of the swirl valve engaging a beveled seat at an outlet of the outlet chamber to form a paint-tight seal between the swirl valve and the seat at the discharge end of the outlet chamber. A number of paint swirl apertures extend through the swirl valve to permit transmission of paint or other material to be sprayed from the outlet chamber to the spray tip. In such prior art guns, the swirl valve was fabricated from a polymer such as nylon. When the spray gun is turned on by actuating the trigger, the motor drives the piston in the pump subassembly to draw paint from the container into the pumping chamber and thereafter move it to the outlet chamber where the paint is forced through the swirl valve apertures at high pressure and allowed to exit the gun via the atomizing spray tip, forming an atomized spray which may be directed to a surface desired to be painted by the operator of the gun.

Along with other parts which have been in contact with paint during operation, the swirl valve is typically removed and cleaned after each use of the spray gun. During reassembly, if the nut holding the spray tip is not tightly screwed onto the pump assembly and the swirl valve properly seated in the discharge end of the outlet chamber before the spray gun is reused, the high pressures developed within the outlet chamber of the pump subassembly can cause paint to get between the surfaces of the swirl valve and the seat at the discharge end of the outlet chamber. If allowed to continue for a substantial length of time, erosion of the swirl valve resulting in uneven and sputtering paint spray can occur as a result. The swirl valve must then be replaced to restore proper operation of the spray gun.

There is, therefore, a continuing need for improved airless paint spray guns. In particular, there is a need for a spray gun having reduced susceptibility to sputtering caused by the swirl valve erosion that occurs in known spray guns. The swirl valve should of course be efficient to manufacture and be easily cleanable after use. The ability to easily and efficiently retrofit existing spray guns is especially desirable.

SUMMARY OF THE INVENTION

The swirl valve of the present invention can be efficiently manufactured and can be retrofitted into existing paint guns. The swirl valve of the present invention is less susceptible to erosion than prior art swirl valves, and thus reduces the potential for erosion and sputtering in the paint spray gun of the present invention.

One embodiment of the swirl valve of the present invention includes a valve body having first and second opposite sides, and formed of a material characterized by a first hardness value. One or more paint swirl apertures extend through the valve body between the first and second opposite sides. The first side of the valve body is a generally planar surface with a recess therein in communication with the swirl apertures. The second side of the valve body has a radial surface parallel to the planar surface of the first side and a cone-shaped or beveled surface radially outward of the radial surface and adapted to mate with a correspondingly beveled seating surface in the outlet chamber. The beveled surface of the swirl valve is preferably formed of an elastomeric material having a hardness less than that of the valve body, permitting a more resilient seating action than that achieved by swirl valves in the prior art.

DETAILED DESCRIPTION OF THE PREFERRED EMBODIMENTS

Figure 1:
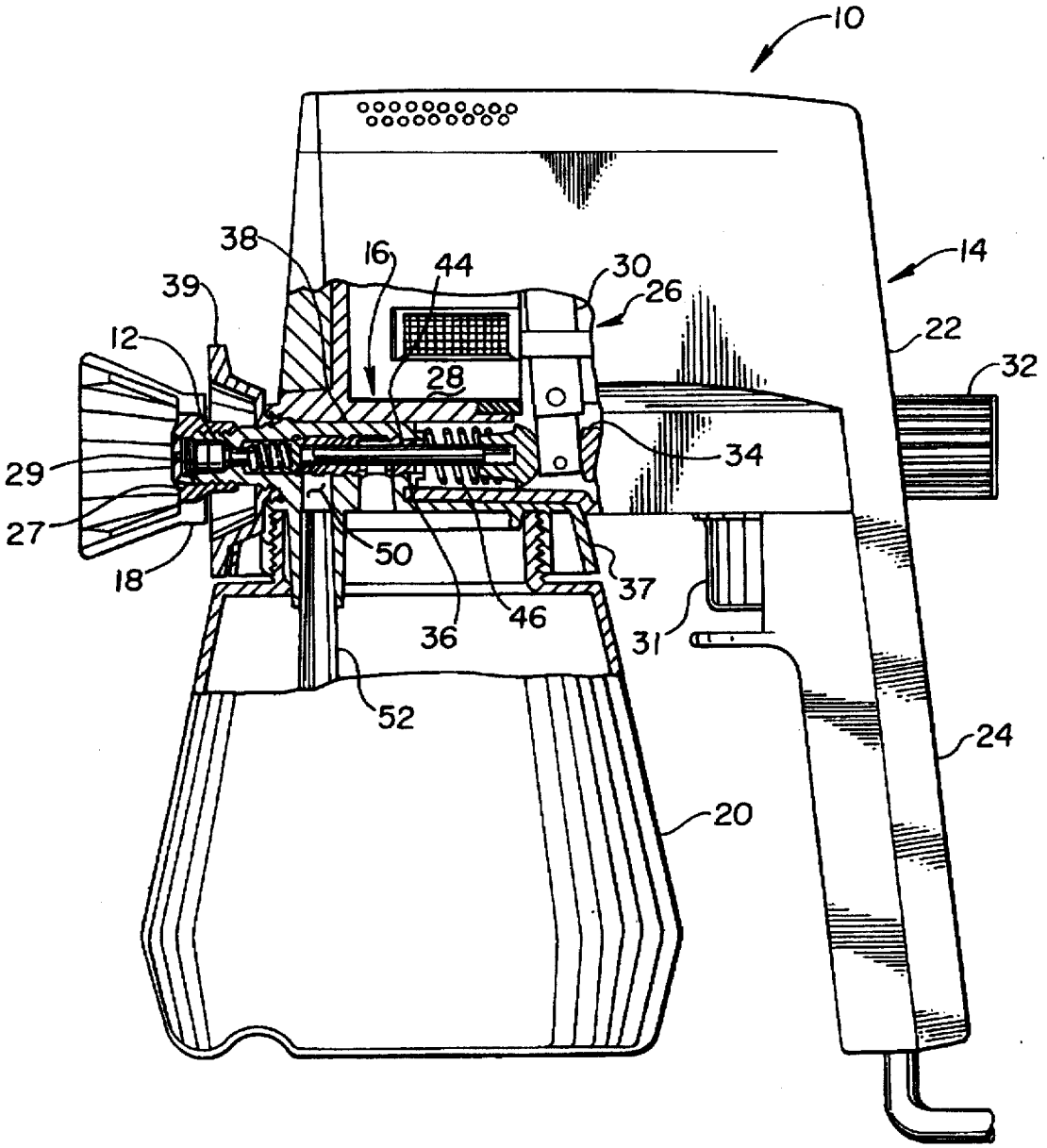
FIG. 1 is a side view of a paint spray gun including a swirl valve useful in the present invention, with a pump subassembly shown in section.

Referring now to the Figures, an airless cup-type paint spray gun 10 which includes a swirl valve 12 in accordance with the present invention is illustrated generally in FIG. 1. As may be seen also in FIGS. 2 and 3, spray gun 10 includes a gun assembly 14, a pump subassembly 16, a spray tip 18 and paint cup or container 20. The gun assembly 14 includes a housing 22 and a handle 24 formed integrally therewith. A motor 26 is mounted within housing 22. Spray tip 18 includes a nut 27 and a nozzle 29 mounted therein. The spray gun 10 is actuated by a trigger-type on/off switch 31 in handle 24. In the embodiment shown, motor 26 is an oscillating armature type device which includes an electromagnet 28 driving an armature 30. The length of the swing of armature 30 is controlled by knob 32 to extend and retract stop 34 thus controlling the pattern of the spray produced by gun 10.

Pump subassembly 16 includes a generally cylindrical pump housing 36 which is mounted to the upper surface of a paint container cover 37 by an integrally molded projection 38. The pump subassembly 16 and the cover 37 are removably secured to the gun assembly 14 by a nut 39. As may be seen most clearly in FIG. 3 (which shows alternative embodiments for spray tip 18 and nut 39), pump housing 36 includes a pumping chamber 40 and a outlet chamber 42. Outlet chamber 42 includes a tapered or beveled seat 56 on its discharge end, and a tapered or beveled seat 58 on its inlet end. Piston 44 is mounted within pump housing 36 and is biased to a retracted position by spring 46. The cover 37 includes a paint-receiving chamber 50. An aperture 48 extends through pump housing 36 between pumping chamber 40 and paint-receiving chamber 50 in cover 37. A suction tube 52 extends from paint-receiving chamber 50 into a container 20, and has a filter 54 (see FIG. 2) on its free end.

Figure 2:
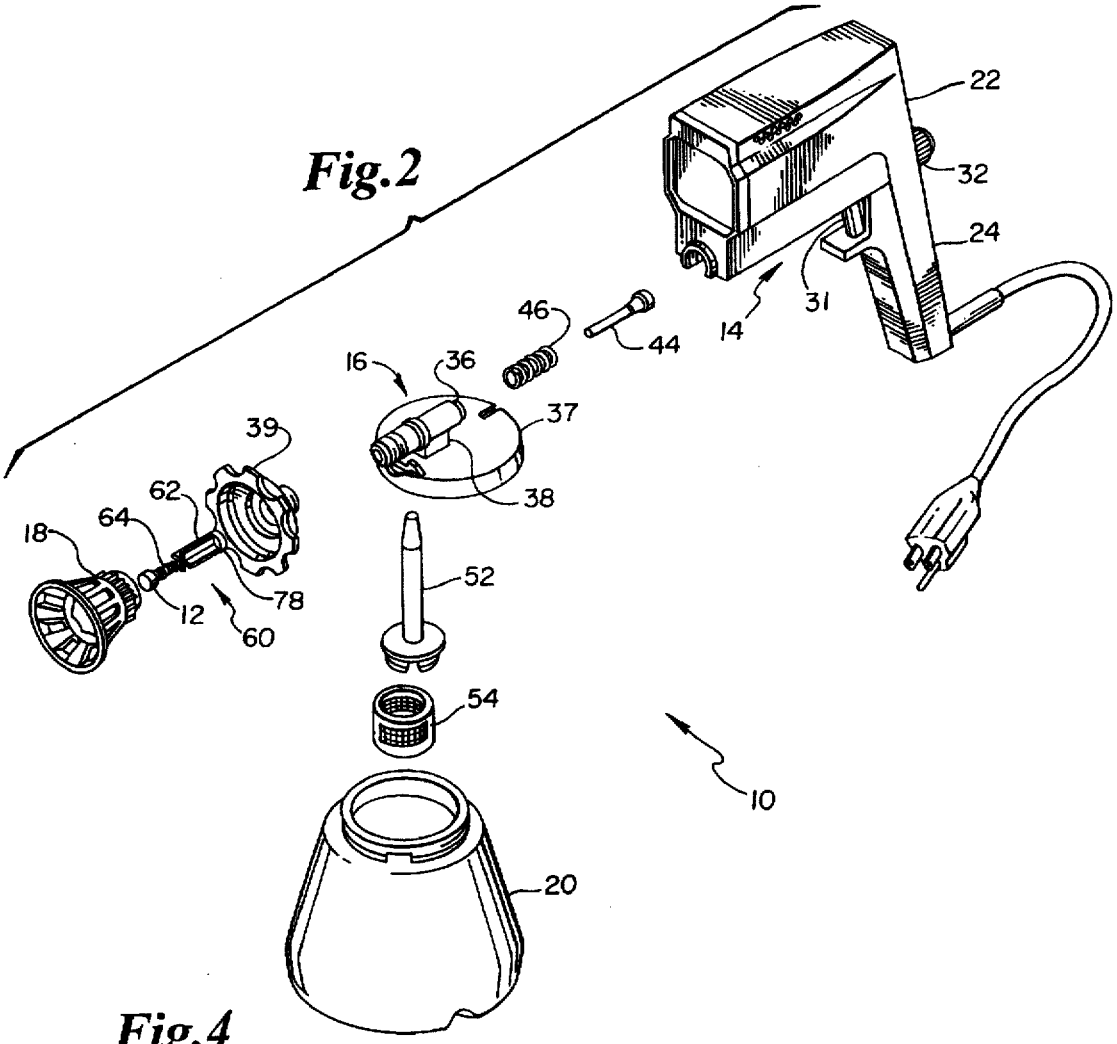
FIG. 2 is an exploded perspective view of the paint spray gun of the present invention shown in FIG. 1.
Figure 4:
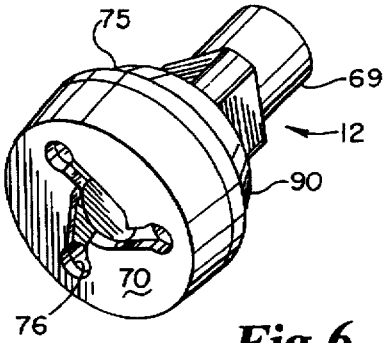
FIG. 4 is an enlarged perspective view of a swirl valve useful in the practice of the present invention.
Figure 5:
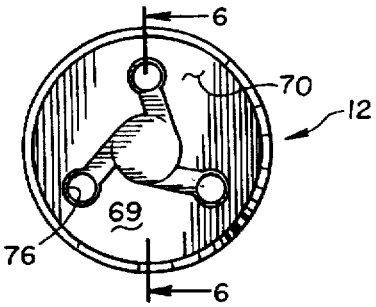
FIG. 5 is a end view of the discharge side of the swirl valve shown in FIG. 4.
Figure 6:
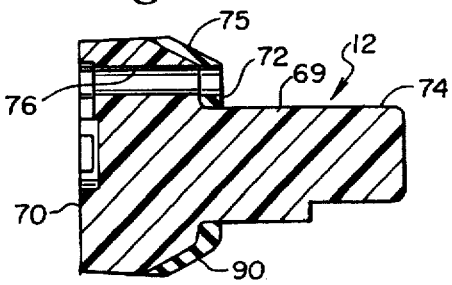
FIG. 6 is a section view of the swirl valve, taken along line 6—6 in FIG. 5.
Figure 3:
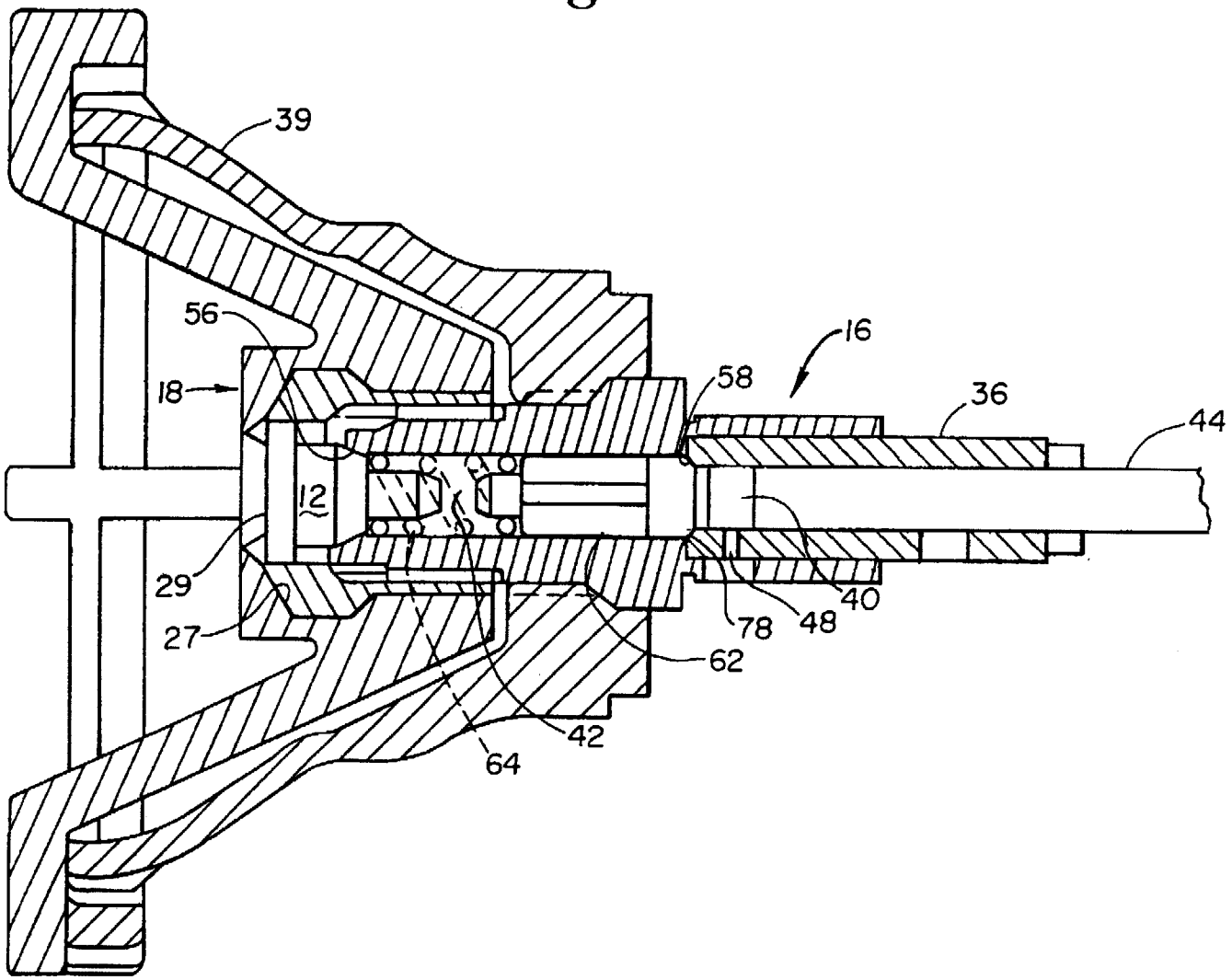
FIG. 3 is an enlarged partial section view of an alternative embodiment of a paint pump subassembly useful in the practice of the present invention.

Referring now most particularly to FIGS. 2 and 3, a atomizer valve assembly 60 includes the swirl valve 12, a poppet valve 62 and a spring 64. Valve assembly 60 is releasably retained within outlet chamber 42 by nozzle 29 when the spray tip 18 is mounted to pump housing 36. As shown in FIGS. 4–6, the swirl valve 12 includes a valve body 69 having a first or discharge side 70, a second or inlet side 72, and a spring projection 74 which extends from the inlet side 72. A plurality of swirl apertures 76 extend through the body of the swirl valve 12 between inlet side 72 and discharge side 70. The inlet side 72 has a beveled surface 75 to engage and mate with the beveled seat 56 on the discharge end of outlet chamber 40. Poppet valve 62 has a beveled surface 78 to engage and mate with the beveled seat 58 on the inlet end of the outlet chamber 42. It is to be understood that it is preferable that the swirl valve 12 be urged against the seat 56 at the discharge end of outlet chamber 42 by spray tip 18, with the beveled surface 75 forming a paint-tight seal against seat 56. Spring 64 biases poppet valve 62 into engagement with the seat 58 at the inlet end of outlet chamber 42.

When switch 31 is actuated to operate spray gun 10, motor 26 drives piston 44 through reciprocating paint-intake and output strokes. During the paint intake strokes, spring 46 forces piston 44 in a rearward direction toward knob 32. A vacuum is thereby formed in the pumping chamber 40 of pump housing 36 since poppet valve 62 is biased into engagement with the seat 58. This vacuum causes paint from container 20 to be drawn into pumping chamber 40 through suction tube 52, paint-receiving chamber 50 and aperture 48 during the paint intake stroke. During the subsequent paint output stroke, piston 44 is driven by motor 26 in a forward direction toward spray tip 18. Forward motion of piston 44 forces the paint within paint pumping chamber 40 to unseat poppet valve 62 and flow into outlet chamber 42. By repeatedly delivering paint into the outlet chamber 42 in this manner, the paint is pressurized and forced through swirl apertures 76 to form a spray pattern as it exits gun 10 through nozzle 29.

As shown in FIGS. 4 and 5, the swirl valve 12 includes an elastomeric material coating or layer 90 on the exterior surface of beveled surface 75. To reduce erosion or wear of swirl valve apertures 76 by the discharge of high pressure paint therethrough, the body of the swirl valve 12 is preferably fabricated from a polymer or other material which results in a relatively rigid and hard part when finished. In one embodiment, the body of the swirl valve 12 is molded from polypropylene which has a hardness value in the range of 80 to 100 durometer SHORE D. Elastomeric material layer 90, on the other hand, is relatively soft with respect to the material from which the body of the swirl valve 12 is fabricated. In one embodiment, elastomeric material layer 90 is also a layer of polypropylene which has a hardness value between 70–100 durometer SHORE D (but which is less than the specific durometer of the valve body).

Known co-molding processes can be used to fabricate the swirl valve 12 with the elastomeric material layer 90 on surface 75. The thickness of elastomeric material layer 90 is about 0.015 inches in this embodiment. One embodiment of the swirl valve 12 is fabricated by Barry Controls of 40 Guest Street, Brighton, Mass., using their Duo-Plexx process. Other vendors capable of the co-molding process include Phillips Plastics Corp. at 1233 International Drive, Eau Claire, Wis. and UFE Incorporated, of 1850 South Greeley Street, Stillwater, Minn.

It is to be understood that various plastics and hardness ranges may be utilized in the swirl valve of the present invention, provided that compatibility with solvents used in the material to be sprayed, (and in the cleanup afterward) and to achieve the life and operating characteristics desired. For example, while polypropylene is preferred, polycarbonates, polyvinyl chloride and ABS all are compatible with polyurethane for the soft material. To accomplish the co-molding desired to produce the swirl valve having the desired soft layer on a hard body, injection molding machines having multiple barrels which enable simultaneous injection molding of two plastics may be employed. For example, such machines have been available from the Nissei Plastic Industrial Co. under model designations Two-Color DC Series 100–200 and 100–300.

A swirl valve having the elastomeric material layer 90 in accordance with the present invention has considerable advantages over conventional swirl valves. In the present invention, the body of the swirl valve, and in particular the interior surface of the swirl apertures, is resistant to wear or erosion by the paint discharged, since it is fabricated from relatively hard material. The relatively soft elastomeric material on the sealing surface 75 facilitates a paint-tight seal with the seat 56 on the discharge end of the outlet chamber. The elastomeric material can also compensate for misalignment of the swirl valve 12 when it seated against the discharge end seat 56 of the outlet chamber 42, thus preventing the wear and leakage paths that might otherwise develop on the beveled seating surface 75 of the swirl valve 12. Uneven and sputtering paint spray is also reduced while extending the life of the swirl valve 12. It is to be understood, however, that if excessive pressure is applied in an axial direction (i.e., along apertures 76), cold flow of layer 90 may result in permanent deformation thereof. While elastic deformation is desirable to fill any voids in housing 36 caused, for example, by erosion, permanent deformation may be undesirable and is preferably avoided.

Although the present invention has been described with reference to preferred embodiments, those skilled in the art will recognize that changes can be made in form and detail without departing from the spirit and scope of the invention.

What is claimed is:

1. A swirl valve for mounting within a seat of a spray paint gun pump housing, comprising:

a valve body having a discharge side and an inlet side, and formed of a material characterized by a first hardness value;

one or more paint swirl apertures extending through the valve body between the discharge and inlet sides;

a beveled seat-engaging surface on the inlet side of the valve body; and elastomeric material on the beveled surface of the valve body, the elastomeric material characterized by a second hardness value which is less than the first hardness value.

2. The swirl valve of claim 1 wherein the elastomeric material has a hardness between about 70 and 100 durometer.

3. The swirl valve of claim 1 wherein the valve body is formed of polypropylene.

4. The swirl valve of claim 1 wherein the valve body is formed of material having a hardness value between 80 and 100 durometer.

5. The swirl valve of claim 3 wherein the elastomeric material on the beveled surface has a hardness between about 70 and 100 durometer.

6. A swirl valve for a spray paint gun comprising:

a valve body having a discharge side and an inlet side, and formed of a relatively hard material;

a plurality of paint swirl apertures extending through the valve body between the discharge and inlet sides;

a beveled seat-engaging surface on the inlet side of the valve body; and a relatively soft elastomeric material layer co-molded with the valve body to form a beveled surface thereon.

7. The swirl valve of claim 6 wherein the elastomeric material has a hardness between about 70 and 100 durometer.

8. The swirl valve of claim 6 wherein the valve body is formed of polypropylene.

9. The swirl valve of claim 6 wherein the elastomeric material forming the beveled surface has a hardness between about 70 and 100 durometer.

10. An improved swirl valve and airless spray paint gun assembly comprising:

a motor, and a paint container; and a pump subassembly including:

a pump housing in fluid communication with the paint container and having a beveled seat at a discharge end of the pump housing, a piston mounted within the pump housing and driven by the motor for pumping paint from the container through the discharge end of the pumping housing, and a swirl valve mounted within the pump housing and including:

a valve body having a discharge side and an inlet side, and formed of a material characterized by a first hardness value, a plurality of paint swirl apertures extending through the valve body between the discharge and inlet sides, a layer of elastomeric material co-molded with the valve body and forming a beveled surface on the valve body, the elastomeric material characterized by a second hardness value which is less than the first hardness value.

11. The improved swirl valve and airless spray paint gun of claim 10 wherein the elastomeric material comprises polypropylene having a hardness of about 70–100 durometer SHORE D.

12. The improved swirl valve and airless spray paint gun of claim 10 wherein the valve body is formed of polypropylene having a hardness of about 80–100 durometer SHORE D.

* * * * *